US005704381A

United States Patent [19]

Millan et al.

[11] Patent Number: 5,704,381

[45] Date of Patent: Jan. 6, 1998

[54] ENCLOSED SPRAY GUN AND ACCESSORIES CLEANING APPARATUS

[75] Inventors: Jorge A. Millan, Lawndale; Arnold J. Comproni, Sylmar; Glen Silva Abad, Lakewood; Duke N. Lee, Cerritos, all of Calif.

[73] Assignee: Northrop Grumman Corporation, Los Angeles, Calif.

[21] Appl. No.: 591,325

[22] Filed: Jan. 25, 1996

[51] Int. Cl.[6] ..... B08B 9/02

[52] U.S. Cl. ..... 134/102.2; 134/169 C; 134/166 C; 134/200; 312/1

[58] Field of Search ..... 134/166 C, 168 C, 134/169 C, 102.3, 104.4, 102.1, 111, 200; 312/1

[56] References Cited

U.S. PATENT DOCUMENTS

| | | | |
|---|---|---|---|
| 2,622,605 | 12/1952 | Brooks | 134/102.1 |
| 2,682,273 | 6/1954 | Roach . | |
| 2,721,566 | 10/1955 | Brucker | 134/102.1 |
| 2,726,667 | 12/1955 | Wigmore . | |
| 2,745,418 | 5/1956 | Balcom et al. | 134/166 R |
| 3,372,704 | 3/1968 | Ashworth | 134/109 |
| 3,771,539 | 11/1973 | DeSantis | 134/111 |
| 4,025,363 | 5/1977 | DeSantis | 134/111 |
| 4,785,836 | 11/1988 | Yamamoto . | |
| 4,881,561 | 11/1989 | Schwarzwalder | 134/111 |
| 4,886,081 | 12/1989 | Blaul . | |
| 4,899,769 | 2/1990 | Tsai | 134/184 |
| 4,923,522 | 5/1990 | Sowers . | |
| 4,960,142 | 10/1990 | Robb et al. . | |
| 4,993,199 | 2/1991 | Hughes . | |
| 5,025,818 | 6/1991 | Kalar . | |
| 5,062,871 | 11/1991 | Lemmon, III . | |
| 5,095,925 | 3/1992 | Elledge et al. . | |
| 5,107,876 | 4/1992 | Ozyjiwsky . | |
| 5,143,102 | 9/1992 | Blaul . | |
| 5,183,066 | 2/1993 | Hethcoat . | |
| 5,193,561 | 3/1993 | Robb et al. . | |
| 5,201,331 | 4/1993 | Tapper . | |
| 5,213,117 | 5/1993 | Yamamoto . | |
| 5,220,933 | 6/1993 | Albers | 134/170 |
| 5,318,056 | 6/1994 | Kusz et al. | 134/166 R |

*Primary Examiner*—Frankie L. Stinson

*Attorney, Agent, or Firm*—Terry J. Anderson; Karl J. Hoch, Jr.

[57] ABSTRACT

An apparatus for the cleaning of spray guns and components thereof, and more particularly, a preferably portable and compact apparatus including an enclosed cabinet structure for the contained cleaning of paint spray guns and various accessories thereof in order to minimize the emission of volatile organic compounds from cleaning solvents.

8 Claims, 2 Drawing Sheets

ENCLOSED SPRAY GUN AND ACCESSORIES CLEANING APPARATUS

BACKGROUND OF THE INVENTION

1. Field of the Invention

The present invention relates to an apparatus for the cleaning of spray guns and components thereof, and more particularly, pertains to a preferably portable and compact apparatus including an enclosed cabinet structure for the contained cleaning of paint spray guns and various accessories thereof in order to minimize the emission of volatile organic compounds from cleaning solvents.

The utilization of spray guns, and particularly paint spray guns is practically universal in conjunction with the most widespread and diverse applications; for example, such as are employed in the painting of automobiles, industrial structures, furniture and other types of surfaces which are too numerous to specify. Generally, such painting equipment; in essence, especially paint spray guns and accessories are subject to contamination and residues from the sprayed materials which remain thereon or adhere thereto as a result of prior paint operations. Consequently, the thorough cleaning of paint spray guns subsequent to their use, or between successive spraying operations, is important in order to eliminate any potential contaminants and paint residues adhering thereto, and additionally the maintenance of the spray guns and accessories in a clean condition between periods of use will to a considerable extent prolong the useful service life of the spray gun equipment.

Heretofore, traditional methods of cleaning paint spray guns and their accessories encompassed steps of manually washing, brushing and rinsing the paint spray guns with suitable solvents, generally comprising volatile organic compounds (VOC), in an open container. The use of gloves by personnel while manually cleaning, although normally recommended, was generally optional. Consequently, emissions of volatile organic compounds and the physical exposures thereto by the cleaning personnel or operator engaged in the cleaning treatment of the paint spray guns and their accessories were quite extensive in the use of such basic methods of cleaning, resulting in frequent cases of physical illness or injuries, with resultant economic losses to employees and employers alike, and potential legal liabilities to the employers.

More recently, relatively strict regulations which have been promulgated by various government environmental regulatory agencies have mandated the use of enclosed paint spray gun cleaning equipment in order to minimize or even completely eliminate the potential emissions of volatile organic compounds to the surroundings or atmosphere during the implementation of spray gun cleaning operations, thereby protecting the environment while, concurrently, reducing and even eliminating the hazards to the operators or personnel while carrying out such cleaning procedures.

2. Discussion of the Prior Art

In order to be able to meet the requirements or standards promulgated by various governmental environmental regulatory mandates, diverse kinds of devices and apparatuses have been developed in the spray gun and accessory cleaning technology designed to implement the necessary environment-friendly cleaning processes employed in removing contaminants and residues from paint spray guns and accessories, without exposing the environment or the operating personnel of the cleaning installations to any health hazards, and simultaneously eliminating emissions or vapors generated by the volatile organic compounds (VOC) of the solvents.

Yamamoto U.S. Pat. No. 5,213,117 discloses an apparatus for cleaning paint guns and accessories wherein a container is adapted to receive the paint guns and/or parts thereof, and a plurality of nozzles are adapted to direct jets of solvent against the paint guns or accessories. A suitable supply source for the solvent in the form of a storage container also includes a pumping arrangement for circulating solvent throughout the closed system and is adapted to aspirate solvent from the removable solvent tank to fill the storage container to a predetermined level.

Blaul U.S. Pat. No. 5,143,102 describes a closed high-pressure parts cleaner including a grit blaster and whereby a pair of gloves adapted to be worn by an operator can extend through glove-mounted ports into the apparatus while the interior is viewed through a window structure to enable manipulating the parts which are to be cleaned. Solvent containers and recirculating components are located exteriorly of the apparatus and are connected thereto by means of various hoses and conduits.

Ozyjiwsky U.S. Pat. No. 5,107,876 discloses a parts washing machine with a storage including a grid for having components which are to be washed positioned thereon, and whereby a porthole formed in the front wall of the machine provides access to a gloved hand mounting porthole structure to enable an operator to manipulate the components and a cleaning device.

Elledge, et al. U.S. Pat. No. 5,095,925 discloses a portable aseptic cleaning tank having portholes with gloves mounted therein extending interiorly of the washing or cleaning apparatus, and which are adapted to enable physical engagement and manipulation of components and jet elements for cleaning the components. Suitable solvent recovery and recycling apparatus is located exteriorly of the apparatus and connected thereto by means of hoses or conduits.

Hughes U.S. Pat. No. 4,993,199 discloses a self-contained portable decontamination booth whereby parts which are to be cleaned may be manipulated by means of gloves attached to the front of the apparatus and extending inwardly thereof through mounting ports, and whereby a specified flow of solvents may be directed against the parts to be cleaned.

Blaul U.S. Pat. No. 4,886,081 discloses an impact or jet-action cleaning and solvent spray apparatus located in a closed chamber. The latter includes portholes mounting gloves into which the gloved hands of an operator may be inserted so as to reach into the apparatus to manipulate the cleaning structure and the parts to be cleaned while avoiding any solvent spray to be emitted to the exterior of the apparatus into the environment.

Finally, Hall U.S. Pat. No. 4,768,533 discloses a paint and varnish stripping system including a plurality of nozzle members arranged within a container or sealed housing, and which are adapted to be supplied with cleaning solvent from a container of the solvent which is passed through a pumping system so as to spray and strip paint and varnish from various components which are to be cleaned.

Although the foregoing patent publications each describes an apparatus for either rinsing, removing, or stripping contaminants and residual paint from various components; for example, such as paint spray guns and accessories, none of these provides for a compact and closed system of preferably portable construction analogous to that described by the inventive apparatus.

SUMMARY OF THE INVENTION

In order to further improve upon the foregoing apparatuses for the cleaning of paint spray guns and various accessories and/or components, which generally provide closed container structures in order to avoid contaminating the environment with volatile organic compound emissions derived from the solvents during the cleaning operations, pursuant to the present invention there is provided a more compact, portable and simply constructed apparatus which achieves the purpose set forth hereinabove through the use of inexpensive and easily operated and maintained components.

Accordingly, it is a basic object of the present invention to provide a novel enclosed spray gun and accessory cleaning apparatus which is of simple and compact construction.

It is a more specific object of the invention to provide an enclosed and self-contained paint spray gun and accessory cleaning apparatus which will eliminate or considerably reduce the emissions of volatile organic compounds derived from cleaning solvents during the operation of the apparatus.

A further object of the present invention resides in the provision of a self-contained enclosed paint spray gun and accessory cleaning apparatus which is compact and portable in nature and which operates with a minimum of components essentially contained within a single housing structure while protecting the environment and the operating personnel from the hazards and deleterious effects of volatile organic compound emissions derived from cleaning solvents.

BRIEF DESCRIPTION OF THE DRAWINGS

Reference may now be had to the following detailed description of a preferred embodiment of an enclosed paint spray gun and accessory cleaning apparatus constructed pursuant to the invention, taken in conjunction with the accompanying drawings; in which.

DETAILED DESCRIPTION OF A PREFERRED EMBODIMENT

Figure 1:
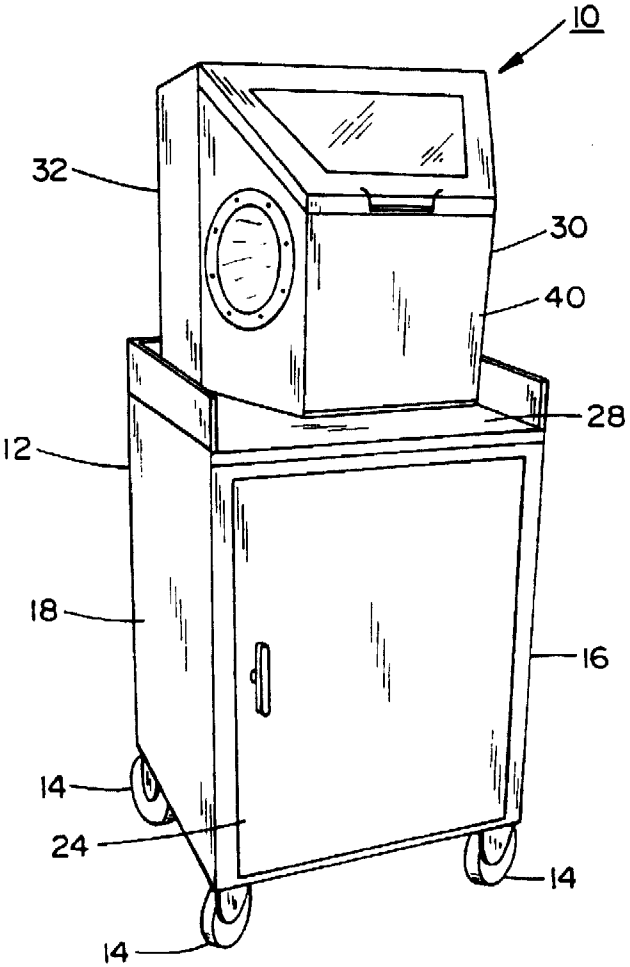
FIG. 1 illustrates a front and side perspective view of the paint spray gun and accessory cleaning apparatus pursuant to the invention.

Referring now in specific detail to the invention, as shown in FIG. 1, there is illustrated an enclosed spray gun cleaning apparatus 10 with a containment in the form of a cabinet 12 which is supported on casters or rollers 14 so as to be portable and readily movable to various positions or locations as needed. The cabinet 12 housing the spray gun or accessory cleaning system, as described hereinbelow, includes a lower, preferably rectangular, cabinet portion 16 having closed side walls and rear walls 18, 20, a bottom wall 22, and a hingedly connected openable front door 24, as shown in the open position in FIG. 2. In this cabinet portion 16 there is adapted to be stored a drum 26 containing a supply of a liquid solvent which is employed for the cleaning of paint spray guns and accessories, as described hereinbelow.

Figure 2:
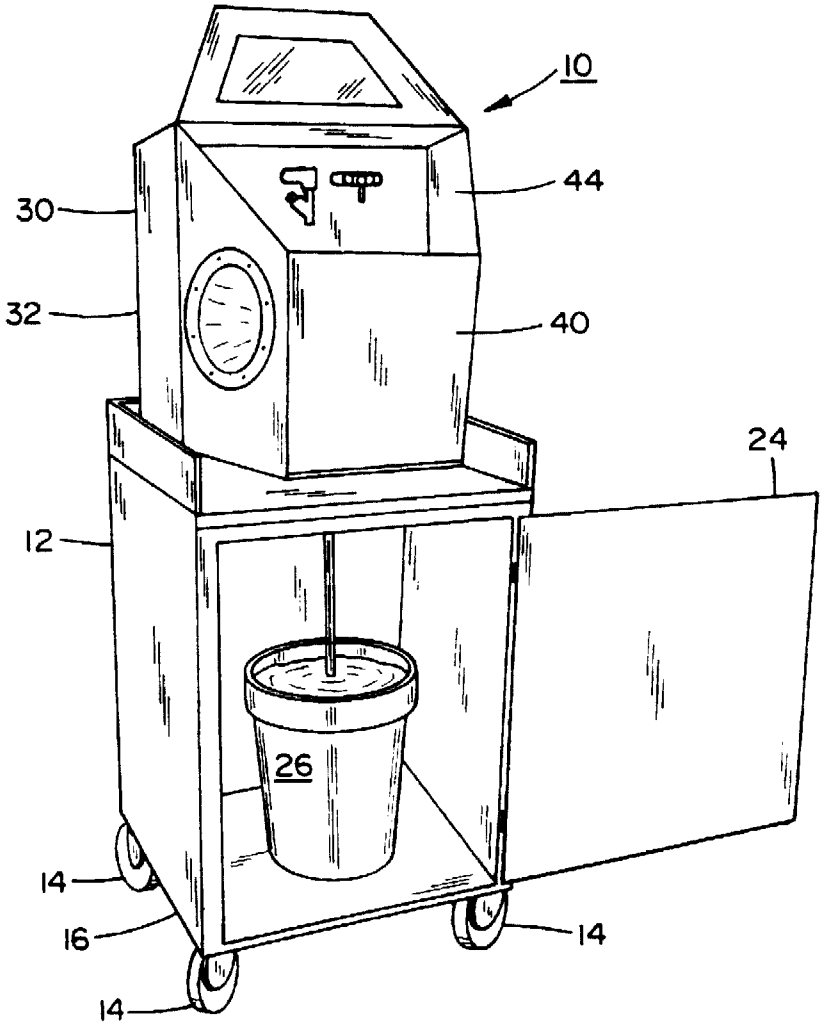
FIG. 2 illustrates a view similar to FIG. 1 showing portions of the interior of the apparatus.
Figure 4:
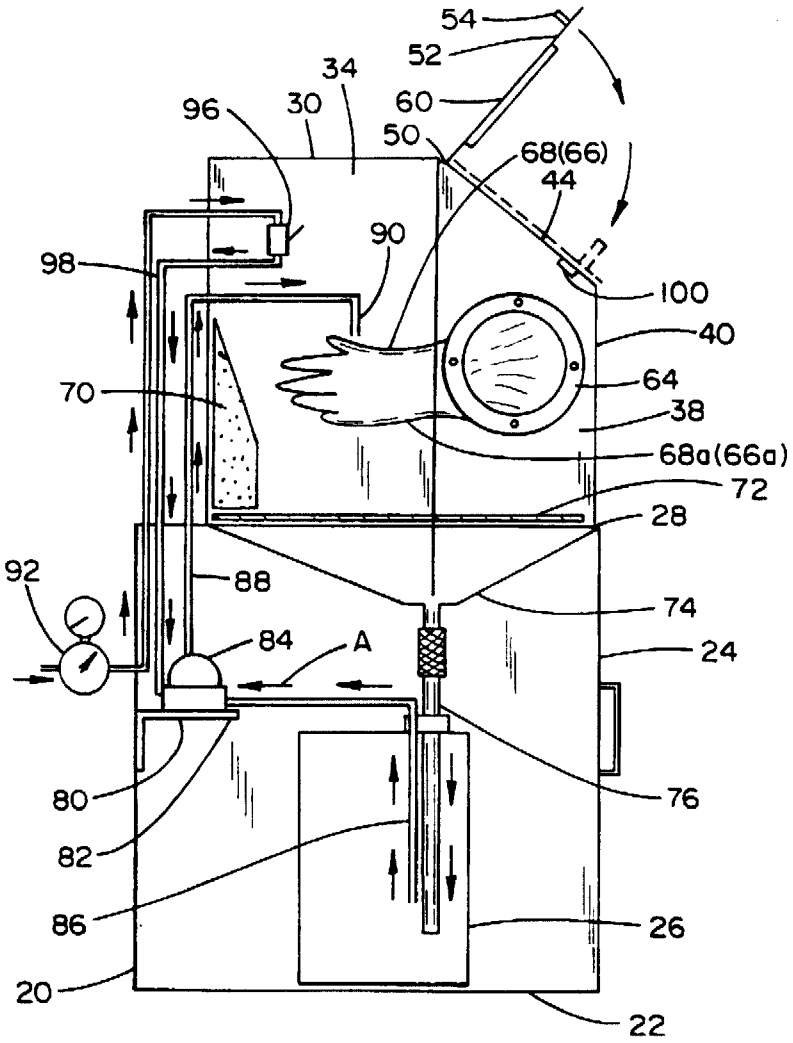
FIG. 4 illustrates a generally diagrammatic sectional view taken along line 4—4 in FIG. 3.

Mounted on an upper horizontal surface or inner ledge 28 of the lower cabinet portion 16 is a further upper cabinet portion 30 having an open bottom so as to communicate with the interior of lower cabinet portion 16, as shown in more specific detail in FIG. 4 of the drawings. The upper cabinet portion 30 has sidewalls 32, 34 which each include forwardly located surface sections 36, 38 which are angled together towards the front of the cabinet portion 30 and which are also inclined or sloped downwardly from their upper edges. The front of the upper cabinet portion 30, which in this instance is a rectangular closed wall 40, extends at its upper end to join the upper front edges of the sidewall surface sections 36, 38 to form a trapezoidal downwardly inclined opening 44. Hinge structure 50 to which there is pivotable connected a downwardly swingable door 52 which possesses a handle 54 and is adapted to be latched in place in a closed position at the upper edge of the front wall 40 as shown herein, extends along the wall edge 56, about which the door 52 may be swung upwardly as shown in FIG. 2 to enable access through opening 44 to the interior of upper cabinet portion 30. The pivotable door 52 is equipped with a glass-covered window 60 to enable visual inspection of the interior of the upper cabinet portion 30.

Figure 3:
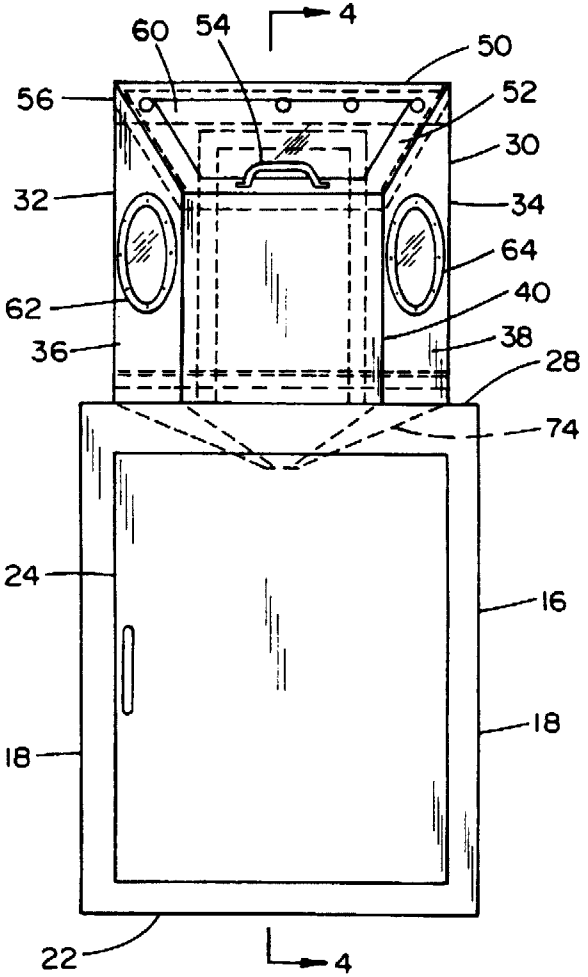
FIG. 3 illustrates a front view of the apparatus of FIG. 1.

The forwardly angled sidewalls 36, 38, as shown in FIG. 3, have the surfaces thereof each provided with circular ports 62, 64 to which there are respectively fastened the cuffs **66*a*, 68*a* of rubber gloves 66, 68 extending into the interior of upper cabinet portion 30, so as to be able to have the hands of an operator inserted into the gloves and extended into the upper cabinet portion 30**, as is illustrated in FIG. 4 of the drawings.

The interior rear section of the upper cabinet portion 30 is provided with an upstanding solvent spray shield 70, and the open bottom surface of the cabinet portion 30 contains filters 72, preferably such as polyester filters, which will permit a flow of solvent downwardly into a funnel- or trough-shaped structure 74 extending into the upper section of the lower cabinet portion 16. The lower end of funnel structure 74 is connected to come into communication with a downwardly depending return suction tube 76 leading into the supply drum 26 for the solvent which is positioned in the lower cabinet portion 16.

The interior rear wall surface of the lower cabinet portion 16 has a bracket 80 mounted thereon, which includes a support surface 82 on which there is fastened in place a suitable suction pump 84 for aspirating solvent from the supply drum 26 in the direction of the arrow A through the intermediary of a riser tube 86, with the pump having a solvent discharge conduit 88 extending upwardly behind shield 70 into the upper cabinet portion 30, and which terminates in an outlet or discharge nozzle 90 for the solvent. Furthermore, an air pressure gauge and regulator 92 connected to a supply of pressurized air (not shown), supplies controlled flows of pressurized air through an upwardly extending conduit or pipe 94 upwardly into a shut-off valve 96, such as a ball valve, situated in the upper cabinet portion 30. The valve 96 is manually operable to convey pressurized air through a conduit 98 into the pump 84 for causing the pressurized air with the flow of solvent extending from the pump to be conveyed to the solvent outlet or discharge nozzle 90 as required. The shut-off valve 96 thus may be selectively activated to either permit a flow of pressurized solvent to impinge against paint gun components or accessories held in a gloved hand by the operator, whereby the operator activates the shutoff valve with the other gloved hand to either facilitate a flow or terminate the flow of pressurized solvent used for cleaning purposes.

The discharged solvent then streams downwardly through the filters 72 into the funnel or trough 74 and then through return tube 76 so as to return into the solvent supply drum 26 cleaned of impurities and ready to be reused by being aspirated through the riser tube 86.

During the entire spray gun cleaning operation, the pivotable door 52 with its glass window 60 is maintained in a latched closed position, and may incorporate a sensor or switch device 100 such that the opening of the door 52 will prevent activation or functioning of the apparatus. In essence, the apparatus will only work with the door 52 in its closed and latched position to prevent egress or escape of solvent emissions to the surroundings.

The supply drum 26 for the solvent which is arranged in the lower cabinet portion 16 may be a simple cylindrical drum, for example a standard five-gallon drum, and can be readily replaced with another drum containing fresh solvent by simply uncoupling the riser and return suction tubes 86, 76, and by being removed through the opened front door 24 of the lower cabinet portion 16, as shown in FIG. 2 of the drawings.

The foregoing spray gun cleaning apparatus 10 provides for a simple and compact construction enabling the selective operation of the solvent dispensing system by an operator activating the shut-off valve 96 with one gloved hand, and by grasping one or more of the various paint spray gun components and/or accessories to be cleaned and manipulating these below nozzle 90 in order to clean all of the contaminated surfaces. Thereafter, upon completion of the cleaning procedure, it is merely necessary to deactivate the system by closing off the shut-off valve 90, and permitting all of the solvent to flow downwardly through the filters 72, through the funnel structure 74 and return suction tube 76 into the drum 26, the suction pump 84 having been concurrently deactivated upon the shutting off of the valve; and then swinging the door 52 into its upwardly open position providing access through opening 44, and removing the spray gun components which have been cleaned through the door opening 44.

From the foregoing, it becomes readily apparent that the inventive paint spray gun and accessory cleaning apparatus 10 is of a simple and compact construction, requiring only a minimum of parts providing an essentially fool-proof closed functioning system which will eliminate or extensively minimize volatile organic compound emissions which could be harmful to the environment and hazardous to the operator of the apparatus.

The overall construction of the cabinet may be of corrosion-resistant metal, with the exception of the glass window providing for visual access and the use of the rubber gloves for manipulating the paint spray gun components and operating the shut-off valve 90.

While there has been shown and described what is considered to be a preferred embodiment of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. An enclosed spray gun and accessories cleaning apparatus for administering solvents containing volatile organic components to the spray gun and accessories; said apparatus comprising:

an enclosure having a first chamber and a second chamber in open communication with said first chamber, said first chamber comprising a cabinet having a plurality of enclosing wall portions, said second chamber being mounted on said first chamber so as to form a unitary housing arrangement for said cleaning apparatus, said unitary housing arrangement being mounted on casters so as to enable apparatus to be transported from location to location on said casters;

a solvent supply stored in said first chamber; conduit means leading from said solvent supply into said second chamber; pump means interposed in said conduit means for aspirating a flow of said solvent from said solvent supply;

means for conveying a flow of pressurized air to said pump means for pressurizing said flow of aspirated solvent into said second chamber, said pump means comprising a suction pump mounted in said first chamber; and pressure gauge and regulator mans being connected to said suction pump for regulating the pressure of said pressurized air; valve means in said pressurized air conveying means for controlling the flow of said pressurized solvent into said second chamber, said valve means comprising a manually operable shut-off ball valve; nozzle means on a discharge end of said conduit means in said second chamber for expelling a stream of solvent against said spray gun and accessories, said second chamber comprising a cabinet having a plurality of enclosing wall surfaces; port means being formed in two opposing said wall surfaces; moisture-impervious rubber gloves extending into said second chamber and having cuffs sealingly attached to each said respective glove means to enable an operator to insert his hands into said gloves to manipulate said spray gun and accessories beneath said solvent discharge nozzle means and to concurrently actuate said valve means to selectively control the discharge of solvent from said nozzle means, said second chamber including an upwardly pivotable door having a sealed window affording visual access to said second chamber and enabling the insertion into and removal of spray gun and accessories from said apparatus in the opened position of said door, and enabling operation of said apparatus in the closed position of said door in which said second chamber is sealed relative to the environment; and sensor means being operatively connected with said pivotable door so as to inhibit functioning of said apparatus in the opened position of said door.

2. An apparatus as claimed in claim 1, wherein said second chamber is superimposed on said first chamber, said stream of solvent expelled from said nozzle means flowing from said second chamber downwardly into said first chamber.

3. An apparatus as claimed in claim 2, wherein funnel means is interposed between said first and second chambers, said funnel means having an upper wider inlet end thereof forming the communication between said first and second chambers and a lower narrow discharge end thereof connected to a return suction tube leading into said solvent supply for returning solvent thereto.

4. An apparatus as claimed in claim 3, wherein filter means extend over the inlet end of said filter means as to strain impurities and contaminants from the solvent being reconveyed into said solvent supply.

5. An apparatus as claimed in claim 4, wherein said filter means comprises at least one polyester filter.

6. An apparatus as claimed in claim 1, wherein said solvent supply comprises a drum containing said solvent, said solvent conveying means being a riser tube extending from said drum to said valve means.

7. An apparatus as claimed in claim 1, wherein said unitary housing arrangement is essentially constituted of a corrosion-resistant metal.

8. An apparatus as claimed in claim 1, wherein at least one of the wall portions of said first chamber includes a door to facilitate replacement of said solvent supply.

* * * * *